US009435013B2

(12) United States Patent
Hata et al.

(10) Patent No.: US 9,435,013 B2
(45) Date of Patent: Sep. 6, 2016

(54) COLD-ROLLED STEEL SHEET AND PROCESS FOR PRODUCTION THEREOF

(75) Inventors: Kengo Hata, Osaka (JP); Toshiro Tomida, Kobe (JP); Norio Imai, Nishinomiya (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 103 days.

(21) Appl. No.: 13/818,351

(22) PCT Filed: Aug. 22, 2011

(86) PCT No.: PCT/JP2011/068854

§ 371 (c)(1),
(2), (4) Date: Apr. 9, 2013

(87) PCT Pub. No.: WO2012/026419

PCT Pub. Date: Mar. 1, 2012

(65) Prior Publication Data

US 2014/0144553 A1 May 29, 2014

(30) Foreign Application Priority Data

Aug. 23, 2010 (JP) ..... 2010-186146

(51) Int. Cl.

| | |
|---|---|
| ***C22C 38/02*** | (2006.01) |
| ***C22C 38/18*** | (2006.01) |
| ***C21D 8/02*** | (2006.01) |
| ***C21D 9/46*** | (2006.01) |
| ***C22C 38/04*** | (2006.01) |
| ***C22C 38/00*** | (2006.01) |
| ***C22C 38/12*** | (2006.01) |
| ***C22C 38/14*** | (2006.01) |

(52) U.S. Cl.

CPC ..... *C22C 38/18* (2013.01); *C21D 8/0226* (2013.01); *C21D 8/0236* (2013.01); *C21D 8/0247* (2013.01); *C21D 8/0273* (2013.01); *C21D 9/46* (2013.01); *C22C 38/002* (2013.01); *C22C 38/005* (2013.01); *C22C 38/02* (2013.01); *C22C 38/04* (2013.01); *C22C 38/12* (2013.01); *C22C 38/14* (2013.01); *C21D 2211/002* (2013.01); *C21D 2211/005* (2013.01)

(58) Field of Classification Search
None
See application file for complete search history.

(56) References Cited

U.S. PATENT DOCUMENTS

| | | | | |
|---|---|---|---|---|
| 2008/0202639 | A1* | 8/2008 | Tomida et al. | 148/506 |
| 2013/0037180 | A1* | 2/2013 | Sano et al. | 148/603 |

FOREIGN PATENT DOCUMENTS

| | | | |
|---|---|---|---|
| CA | 2310335 | C * | 5/2009 |
| JP | 07-034136 | | 2/1995 |
| JP | 09194935 | A * | 7/1997 |
| JP | 2002-180191 | | 6/2002 |
| JP | 2004-250774 | | 9/2004 |
| JP | 2005-298956 | | 10/2005 |
| JP | 2007-092131 | | 4/2007 |
| JP | 2008-231480 | | 10/2008 |
| JP | 2009-263718 | | 11/2009 |
| WO | 2007/015541 | | 2/2007 |
| WO | WO 2011093319 | A1 * | 8/2011 |

* cited by examiner

*Primary Examiner* — Roy King
*Assistant Examiner* — Jophy S Koshy
(74) *Attorney, Agent, or Firm* — Clark & Brody

(57) ABSTRACT

A cold-rolled steel sheet having a refined structure in which grain growth during annealing is suppressed has a chemical composition containing, in mass percent, controlled amounts of carbon, manganese, niobium, titanium, vanadium, sol. Aluminum, chromium, molybdenum, boron, calcium, and REM and a microstructure which contains at least 50% by area of ferrite as a main phase, a second phase containing at least 10% by area of a low temperature transformation phase and 0-3% by area of retained austenite and which satisfies the following Equations (1)-(3), in addition to a particular texture, $$d_m<2.7+10000/(5+300\times C+50\times Mn+4000\times Nb+2000\times Ti+400\times V)^2 \quad (1),$$

$$d_m<4.0 \quad (2),$$

and $$d_s\leq 1.5 \quad (3),$$

wherein $d_m$ is the average grain diameter (μm) of ferrite defined by a high angle grain boundary having a tilt angle of at least 15°, and $d_s$ is the average grain diameter (μm) of the second phase.

8 Claims, 2 Drawing Sheets

COLD-ROLLED STEEL SHEET AND PROCESS FOR PRODUCTION THEREOF

TECHNICAL FIELD

This invention relates to a cold-rolled steel sheet and a process for producing the same. More particularly, the present invention relates to a cold-rolled steel sheet having excellent workability in addition to a high strength and a process for manufacturing a cold-rolled steel sheet with excellent stability of material properties.

BACKGROUND ART

From in the past, there have been many studies of methods of refining the structure of a cold-rolled steel sheet in order to improve the mechanical properties of the steel sheet.

These methods can be generally divided into the following categories (1)-(3).

(1) A first method is a method in which a large amount of elements which suppress grain growth such as Ti, Nb, and Mo are added to refine austenite grains which are formed at the time of annealing after cold rolling, thereby refining ferrite grains which are formed by transformation from austenite in subsequent cooling.

(2) A second method is a method in which heating to a single-phase austenitic region in the above-described annealing is carried out by rapid heating followed by holding for an extremely short length of time to prevent coarsening of the structure.

(3) A third method is a method in which cold rolling and annealing are carried out on a hot-rolled steel sheet manufactured by rapid cooling immediately after hot rolling. Below, this method of manufacturing a hot-rolled steel sheet will be referred to as the immediate cooling method.

With respect to the above-described first method, Patent Document 1, for example, discloses a cold-rolled steel sheet having a steel structure primarily comprising ferrite with an average grain diameter of at most 3.5 μm. Patent Document 2 discloses a cold-rolled steel sheet having a structure comprising ferrite and a low temperature transformation phase constituted by one or more selected from martensite, bainite, and retained γ (retained austenite). The average grain diameter of the low temperature transformation phase is at most 2 μm and its volume fraction is 10-50%.

Concerning the second method, Patent Document 3, for example, discloses a method in which a hot-rolled steel sheet which was coiled at 500° C. or above is cold-rolled and then annealed by rapid heating at a rate of at least 30° C. per second in the temperature range from room temperature to 750° C. and limiting the holding time at an annealing temperature in the range of 750-900° C., thereby causing transformation from unrecrystallized ferrite to fine austenite, from which fine ferrite is formed at the time of cooling. Patent Document 4 describes a method of manufacturing a bake hardenable high strength cold-rolled steel sheet comprising cold rolling a hot-rolled steel sheet obtained by usual hot rolling, and then subjecting the steel sheet to continuous annealing by heating to a temperature range of 730-830° C. at a rate of 300-2000° C. per second in a temperature region of at least 500° C. followed by holding in the temperature range for at most 2 seconds.

Concerning the third method, Patent Document 5 discloses a method in which cold rolling is carried out on a hot-rolled steel sheet produced by the immediate rapid cooling method in which cooling is started a short time after hot rolling. For example, a hot-rolled steel sheet having a fine structure and predominantly comprising ferrite with a small average grain diameter is produced by cooling to a temperature of 720° C. or below at a cooling rate of at least 400° C. per second within 0.4 seconds after the completion of hot rolling and is used as a starting material for cold rolling, and cold rolling and annealing are carried out in a usual manner.

In Patent Document 5, a region which is surrounded by a high angle grain boundary for which the misorientation (also referred to as the tilt angle) is at least 15° is defined as a single (crystal) grain. Accordingly, a hot-rolled steel sheet having a fine structure disclosed by Patent Document 5 is characterized by having a large number of high angle grain boundaries.

PRIOR ART DOCUMENTS

Patent Documents

Patent Document 1: JP 2004-250774 A
Patent Document 2: JP 2008-231480 A
Patent Document 3: JP 2007-92131 A
Patent Document 4: JP 7-34136 A
Patent Document 5: WO 2007/015541

SUMMARY OF THE INVENTION

As stated above, in the prior art, there have been many studies of methods for refining the structure of a cold-rolled steel sheet with the object of improving the mechanical properties of the steel sheet. However, as stated below, none of the conventional methods were completely satisfactory.

In the method disclosed in Patent Document 1 and Patent Document 2, due to the addition of Ti, Nb, or similar element which is essential, problems remain from the standpoint of resource conservation.

In the method disclosed in Patent Document 3, as shown by the examples, in order to obtain a structure having fine grains such as a structure comprising ferrite grains with an average grain diameter of less than 3.5 μm, it is necessary to make the holding time at the time of annealing a short time of at most around 10 seconds. Examples in which the holding time at the time of annealing is 30 seconds or 200 seconds are shown therein, but the average grain diameter after annealing becomes 3.8 μm or 4.4 μm, indicating that abrupt grain growth takes place. In order to increase the stability of manufacture of a steel sheet, it has normally been considered necessary for the holding time in an annealing step to be at least several tens of seconds. Therefore, with the method disclosed in Patent Document 3, it is difficult to obtain both manufacturing stability and an extremely fine structure of less than 3.5 μm.

Similarly, the method disclosed in Patent Document 4 limits the holding time during annealing to at most 2 seconds. Thus, it makes it necessary to carry out annealing in an extremely short time and has the same problems as the method disclosed in Patent Document 3.

A method employing immediate rapid cooling disclosed in Patent Document 5 is excellent as a means for refining the microstructure of a cold-rolled steel sheet. However, the ferrite grain diameter of a cold-rolled steel sheet is approximately the same as or larger by 1-3 μm than the ferrite grain diameter of a hot-rolled steel sheet which is the starting material. Therefore, there is a limit to refining the microstructure of a cold-rolled steel sheet.

The object of the present invention is to solve the above-described problems of the prior art with respect to a cold-rolled steel sheet having a refined structure. More specifically, the object of the present invention is to provide a cold-rolled steel sheet which has a fine structure even if Ti, Nb, or the like is not added and even if the holding time for annealing is made long enough to obtain a stable material and which has a ferrite grain diameter which is the same as or smaller than the ferrite grain diameter of a hot-rolled steel sheet and a process for manufacturing such cold-rolled steel sheet.

The present inventors performed detailed investigations with the object of solving the above-described problems.

First, they investigated the cause of why the ferrite grain diameter of the cold-rolled steel sheet disclosed in Patent Document 5, which is excellent as a means for refining the microstructure of a cold-rolled steel sheet, is approximately the same as or 1-3 μm larger than the ferrite grain diameter of a hot-rolled steel sheet, and they obtained the following knowledge (a)-(c).

(a) The method disclosed in Patent Document 5 is based on the technical concept that when cold rolling and annealing are carried out on a hot-rolled steel sheet which is obtained by the immediate rapid cooling method and which has a thermally stable fine grain structure having a large number of high angle grain boundaries, a large number of recrystallization nuclei form on the grain boundaries of the hot-rolled steel sheet, thereby refining the structure after cold rolling and annealing.

(b) However, the speed of grain growth of recrystallized grains which grow from recrystallization nuclei which are formed on the grain boundaries of a hot-rolled steel sheet at the time of annealing markedly increases as the structure of a hot-rolled steel sheet is refined.

(c) The effect of refining the structure of a cold-rolled steel sheet by the method disclosed in Patent Document 5 is decreased by the above-described active grain growth of the recrystallized grains, and the ferrite grain diameter of a cold-rolled steel sheet ends up being nearly the same as or 1-3 μm larger than the ferrite grain diameter of a hot-rolled steel sheet.

Accordingly, the present inventors investigated how to suppress the above-described active grain growth of recrystallized grains and acquired the following new knowledge (d)-(i).

(d) When performing cold rolling followed by annealing on a hot-rolled steel sheet having a fine structure, by carrying out annealing by rapid heating so as to reach a temperature at which ferrite and austenite coexist before recrystallization of ferrite (which has a deformed texture due to cold rolling) is completed, a fine structure having a ferrite grain diameter which is the same as or smaller than the ferrite grain diameter of the hot-rolled steel sheet is obtained.

(e) This is because the annealing by rapid heating causes a large number of refined austenite grains to form from locations which were high angle grain boundaries of the hot-rolled steel sheet (prior grain boundaries) in a state in which unrecrystallized ferrite remains. Due to the presence of the large number of refined austenite grains, the growth of recrystallized ferrite grains beyond the prior grain boundaries of the hot-rolled steel sheet is suppressed.

(f) By refining the structure of a hot-rolled steel sheet, it is possible to refine the structure at the time of annealing after cold rolling. However, the more the structure of a hot-rolled steel sheet is refined, the more the rate of grain growth of recrystallized grains increases. Therefore, in order to obtain a refined structure after annealing, it is necessary to perform annealing by rapid heating at a further increased rate of temperature increase.

(g) By using this grain growth suppressing mechanism, even if the holding time during annealing is extended to, for example, from 30 seconds to several hundred seconds, grain growth is suppressed, and a fine structure is maintained. As a result, variations in material properties caused by variations in manufacturing conditions such as the strip running speed can be suppressed, and a cold-rolled steel sheet having stable material properties can be obtained.

(h) A cold-rolled steel sheet which is manufactured by such a manufacturing process has a texture which is characterized in that the average X-ray intensity for the {111}<145>, {111}<123>, and {554}<225> orientations at a depth of ½ of the sheet thickness is at least 4.0 times the average X-ray intensity of a random structure which does not have a texture. A cold-rolled steel sheet having such a texture has good stretch flangeability (hole expanding formability).

(i) It is sufficient for a hot-rolled sheet which is subjected to cold rolling to have a fine structure, but it is preferable that it have excellent thermal stability.

The present invention which is based on these new findings is as follows.

(1) A cold-rolled steel sheet characterized by having:

a chemical composition comprising, in mass %, C: 0.01-0.3%, Si: 0.01-2.0%, Mn: 0.5-3.5%, P: at most 0.1%, S: at most 0.05%, Nb: 0-0.03%, Ti: 0-0.06%, V: 0-0.3%, sol. Al: 0-2.0%, Cr: 0-1.0%, Mo: 0-0.3%, B: 0-0.003%, Ca: 0-0.003%, REM: 0-0.003%, and a remainder of Fe and impurities;

a microstructure having a main phase of ferrite which comprises at least 50% by area and a second phase which contains a total of at least 10% by area of a low temperature transformation phase including one or more of martensite, bainite, pearlite, and cementite and 0-3% by area of retained austenite, and satisfying the following Equations (1)-(3); and a texture in which the average X-ray intensity for the {111}<145>, {111}<123>, and {554}<225> orientations at a depth of ½ of the sheet thickness is at least 4.0 times the average X-ray intensity of a random structure which does not have a texture:

$$d_m < E_1; \quad \text{Equation (1):}$$

$$d_m < 4.0; \quad \text{Equation (2):}$$

$$d_s \leq 1.5; \quad \text{Equation (3):}$$

wherein, $E_1$ in Equation (1) represents a calculated value for the cold rolled sheet and calculated by $E_1=2.7+10000/(5+300\times C+50\times Mn+4000\times Nb+2000\times Ti+400\times V$, wherein C, Mn, Nb, Ti, and V indicate the contents in mass % of the respective elements;

in Equations (1) and (2), $d_m$ is a physical value for the cold rolled sheet characterized by an average grain diameter in μm of ferrite defined by a high angle grain boundary having a tilt angle of at least 15 degrees, and in Equation (3), $d_s$ is a physical value for the cold rolled sheet characterized by an average grain diameter in μm of the second phase.

(2) A cold-rolled steel sheet as set forth above in (1) wherein the chemical composition contains, in mass percent, one or more elements selected from Nb: at least 0.003%, Ti:

at least 0.005%, and V: at least 0.01%, and the microstructure satisfies the following Equation (4):

$$d_m<3.5 \quad (4)$$

wherein $d_m$ is as defined above.

(3) A cold-rolled steel sheet as set forth above in (1) or (2) wherein the chemical composition contains, in mass percent, sol. Al: at least 0.1%.

(4) A cold-rolled steel sheet as set forth above in any of (1)-(3) wherein the chemical composition contains, in mass percent, one or more elements selected from Cr: at least 0.03%, Mo: at least 0.01%, and B: at least 0.0005%.

(5) A cold-rolled steel sheet as set forth above in any of (1)-(4) wherein the chemical composition contains, in mass percent, one or two elements selected from Ca: at least 0.0005%, and REM: at least 0.0005%.

(6) A cold-rolled steel sheet as set forth above in any of (1)-(5) having a plating layer on the surface of the steel sheet.

(7) A process for manufacturing a cold-rolled steel sheet characterized by comprising the following steps (A) and (B):

(A) a cold rolling step in which a hot-rolled steel sheet having a chemical composition as set forth above in any of (1)-(5) and having a microstructure which satisfies the following Equations (5) and (6) is subjected to cold rolling to obtain a cold-rolled steel sheet, and (B) an annealing step in which the cold-rolled steel sheet obtained in Step (A) is subjected to annealing by increasing the temperature of the steel sheet to a temperature range of at least ($Ae_1$ point+10° C.) to at most (0.95×$Ae_3$ point+0.05×$Ae_1$ point) under conditions such that the proportion of unrecrystallized ferrite is at least 30% by area when the temperature ($Ae_1$ point+10° C.) is reached and then holding the steel sheet in this temperature range for at least 30 seconds:

$$d_n<E_5; \quad \text{Equation (5):}$$

$$d_n<3.5; \quad \text{Equation (6):}$$

wherein, $E_5$ in Equation (5) represents a calculated value for the hot rolled sheet and calculated by $E_5=2.5+6000/(5+350\times C+40\times Mn)^2$, wherein C and Mn are the contents in mass % of the respective elements;

in Equations (5) and (6), $d_n$ is a physical value for the hot rolled sheet characterized by an average grain diameter in μm of ferrite defined by a high grade angle boundary having a tilt angle of at least 15 degrees.

(8) A process for manufacturing a cold-rolled steel sheet as set forth above in (7) wherein the hot-rolled steel sheet is obtained by a hot rolling step comprising performing hot rolling with a temperature at the completion of rolling of at least the $Ar_3$ point on a slab having the above-described chemical composition and then performing cooling to a temperature range of 750° C. or below at an average cooling rate of at least 400° C. per second within 0.4 seconds after completion of rolling.

(9) A process for manufacturing a cold-rolled steel sheet as set forth above in (7) or (8) further including a step of applying plating to the cold-rolled steel sheet after step (B).

In this description, the main phase means the phase or structure having the largest percentage by volume (in the present invention, the volume percentage is actually evaluated by the area percentage in a cross section), and a second phase means a phase or structure other than the main phase.

Ferrite includes polygonal ferrite and bainitic ferrite. A low temperature transformation phase (a phase formed by low temperature transformation) includes martensite, bainite, pearlite, and cementite. Martensite includes tempered martensite, and bainite includes tempered bainite A cold-rolled steel sheet according to the present invention has a structure which is refined on the same level or more compared to the hot-rolled steel sheet used as a starting material. Therefore, it has excellent workability while having a high strength, and it is suitable as a steel sheet for automobiles. In addition, it does not require the addition of a large amount of rare metals such as Nb or Ti, which is advantageous from the standpoint of conservation of resources. Since this cold-rolled steel sheet is manufactured by a process according to the present invention which does not make the annealing time a short length of time, it has stable material properties.

MODES FOR CARRYING OUT THE INVENTION

Figure 1:
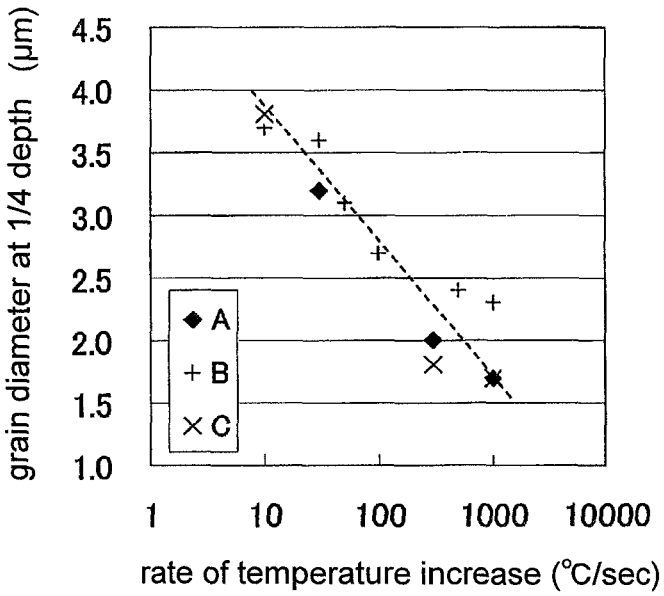
FIG. 1 is a graph showing the relationship between the average grain diameter of a cold-rolled steel sheet and the rate of temperature increase for cold-rolled steel sheets made of steel types A, B, and C which were used in the examples and which were annealed by heating to 750° C. at various rates of temperature increase and then holding for 60 seconds at that temperature.

Below, a cold-rolled steel sheet according to the present invention and a process for manufacturing the same will be described. In the following explanation, percent with respect to chemical composition means mass percent.

1. Cold-Rolled Steel Sheet 1.1—Chemical Composition

C: 0.01-0.3%

C has the effect of increasing the strength of steel. In addition, it has the effect of refining the microstructure during a hot rolling step and an annealing step. Namely, C has the effect of lowering the transformation point. Therefore, during a hot rolling step, it makes it possible to complete hot rolling in a lower temperature range, thereby making it possible to refine the microstructure of a hot-rolled steel sheet. In an annealing step, due to the effect of C by which recrystallization of ferrite is suppressed in the course of temperature increase, it is facilitated to reach a temperature range of at least ($Ae_1$ point+10° C.) by rapid heating while maintaining a state with a high percentage of unrecrystallized ferrite. As a result, it becomes possible to refine the microstructure of a cold-rolled steel sheet. If the C content is less than 0.01%, it is difficult to obtain the above-described effects. Accordingly, the C content is made at least 0.01%. It is preferably at least 0.03% and more preferably at least 0.05%. If the C content exceeds 0.3%, there is a marked decrease in workability and weldability. Accordingly, the C content is made at most 0.3%. Preferably it is at most 0.2% and more preferably at most 0.15%.

Si: 0.01-2.0%

Si has the effect of increasing the ductility and strength of steel. In addition, when it is added along with Mn, it promotes the formation of a hard second phase such as martensite (a phase which is harder than ferrite forming the main phase), and it has the effect of increasing the strength of steel. If the Si content is less than 0.01%, it is difficult to obtain the above-described effects. Accordingly, the Si content is made at least 0.01%. Preferably it is at least 0.03% and more preferably at least 0.05%. On the other hand, if the Si content exceeds 2.0%, oxides are formed on the surface of the steel during hot rolling or annealing and the surface condition is sometimes worsened. Accordingly, the Si content is made at most 2.0%. Preferably it is at most 1.5% and more preferably at most 0.5%.

Mn: 0.5-3.5%

Mn has the effect of increasing the strength of steel. In addition, it has the effect of decreasing the transformation temperature. As a result, during an annealing step, it is facilitated to reach a temperature range of at least ($Ae_1$ point+10° C.) by rapid heating while maintaining a state with a high percentage of unrecrystallized ferrite, and it becomes possible to refine the microstructure of a cold-rolled steel sheet. If the Mn content is less than 0.5%, it becomes difficult to obtain the above-described effects. Accordingly, the Mn content is made at least 0.5%. Preferably it is at least 0.7% and more preferably at least 1%. However, if the Mn content exceeds 3.5%, ferrite transformation is excessively delayed, and it may not be possible to guarantee the desired area percentage of ferrite. Accordingly, the Mn content is made at most 3.5%. Preferably it is at most 3.0% and more preferably at most 2.8%.

P: at most 0.1%

P, which is contained as an impurity, has the action of embrittling the material by segregation at grain boundaries. If the P content exceeds 0.1%, embrittlement due to the above action becomes marked. Accordingly, the P content is made at most 0.1%. Preferably it is at most 0.06%. The P content is preferably as low as possible, so it is not necessary to set a lower limit therefor. From the standpoint of costs, it is preferably at least 0.001%.

S: at most 0.05%

S, which is contained as an impurity, has the action of lowering the ductility of steel by forming sulfide-type inclusions in steel. If the S content exceeds 0.05%, there may be a marked decrease in ductility due to the above-described action. Accordingly, the S content is made at most 0.05%. It is preferably at most 0.008% and more preferably at most 0.003%. The S content is preferably as low as possible, so it is not necessary to set a low limit therefor. From the standpoint of costs, it is preferably at least 0.001%.

Nb: 0-0.03%, Ti: 0-0.06%, V: 0-0.3%

Nb, Ti, and V precipitate in steel as carbides or nitrides, and during cooling in an annealing step, they suppress transformation from austenite to ferrite and thereby have the effect of increasing the percent by area of a hard second phase and increase the strength of steel. Accordingly, one or more of these elements may be contained in the chemical composition of the steel. However, if the contents of these elements exceed the above-described upper limits, there is sometimes a marked decrease in ductility. Accordingly, the content of each element is as given above. The Ti content is preferably at most 0.03%. The total content of Nb and Ti is preferably at most 0.06% and more preferably at most 0.03%. The contents of Nb, Ti, and V preferably satisfy the following Equation (7). In order to obtain the above-described effects with greater certainty, the contents preferably satisfy any one of Nb: at least 0.003%, Ti: at least 0.005%, and V: at least 0.01%.

$$(Nb+0.5\times Ti+0.01\times V)\leq 0.02 \quad (7)$$

wherein Nb, Ti, and V are the contents (mass percent) of the respective elements.

sol. Al: 0-2.0%

Al has the effect of increasing ductility. Accordingly, Al may be contained in the steel composition. However, Al has the action of increasing the transformation point. If the sol. Al content exceeds 2.0%, it becomes necessary to complete hot rolling in a higher temperature range. As a result, it becomes difficult to refine the structure of a hot-rolled steel sheet and it therefore becomes difficult to refine the structure of a cold-rolled steel sheet. In addition, continuous casting sometimes becomes difficult. Accordingly, the sol. Al content is made at most 2.0%. In order to obtain the above-described effect of Al with greater certainty, the sol. Al content is preferably at least 0.1%.

Cr: 0-1.0%, Mo: 0-0.3%, B: 0-0.003%

Cr, Mo, and B have the effect of increasing the strength of steel by increasing the hardenability of steel and promoting the formation of a low temperature transformation phase. Accordingly, one or more of these elements may be contained in the steel composition. However, if the contents of these elements exceed the above-described upper limits, there are cases in which ferrite transformation is excessively suppressed and it is not possible to guarantee the desired percent area of ferrite. Accordingly, the contents of these elements are as set forth above. The Mo content is preferably at most 0.2%. In order to obtain the above-described effects with greater certainty, the contents preferably satisfy any one of Cr: at least 0.03%, Mo: at least 0.01%, and B: at least 0.0005%.

Ca: 0-0.003%, REM: 0-0.003%

Ca and REM have the effect of refining oxides and nitrides which precipitate during solidification of molten steel and thereby increasing the soundness of a slab. Accordingly, one or more of these elements may be contained. However, each of these elements is expensive, so the content of each element is made at most 0.003%. The total content of these elements is preferably at most 0.005%. In order to obtain the above-described effects with greater certainty, the content of either element is preferably at least 0.0005%. REM indicates the total of 17 elements including Sc, Y, and lanthanoids. Lanthanoids are industrially added in the form of a mish metal. The content of REM in the present invention means the total content of these elements.

1.2—Microstructure and Texture

Main Phase: ferrite which is present in a proportion of at least 50% by area and which satisfies above Equations (1) and (2).

By making the main phase ferrite which is soft, it is possible to increase the ductility of a cold-rolled steel sheet. In addition, by making the main phase of ferrite fine so that the average grain diameter $d_m$ of ferrite which is defined by a high angle grain boundary with a tilt angle of at least 15° satisfies above Equations (1) and (2), the formation and development of fine cracks at the time of working of a steel sheet are suppressed, and the stretch flangeability of the cold-rolled steel sheet is increased. In addition, the strength of steel is increased by grain refinement strengthening. Above-described Equation (1) is an index which represents the extent of refinement of ferrite taking into consideration the effects of C, Mn, Nb, Ti, and V on refining the structure.

If the percent by area of ferrite is less than 50%, it becomes difficult to guarantee excellent ductility. Accordingly, the percent by area of ferrite is made at least 50%. The percent by area of ferrite is preferably at least 60% and more preferably at least 70%.

If the average grain diameter $d_m$ of ferrite does not satisfy at least one of above Equations (1) and (2), the main phase is not sufficiently fine. As a result, it becomes difficult to guarantee excellent stretch flangeability, and the effect of increasing strength by grain refinement strengthening is not sufficiently obtained. Accordingly, the average grain diameter $d_m$ of ferrite is made to satisfy above Equations (1) and (2).

The average grain diameter of ferrite which is surrounded by a high (large) angle (tilt) grain boundary having a tilt angle of at least 15° is used as an index because a small angle grain boundary with a tilt angle of less than 15° has a small difference in orientation between adjoining grains, and the effect of accumulating dislocations is small, leading to little contribution to increasing strength. Below, the average grain diameter of ferrite defined by a high angle grain boundary with a tilt angle of at least 15° is referred to simply as the average grain diameter of ferrite.

When the steel has a chemical composition containing one or more elements selected from Nb: at least 0.003%, Ti: at least 0.005%, and V: at least 0.01%, the average grain diameter $d_m$ of ferrite preferably satisfies the above-described Equation (4).

Second Phase: Containing at least 10% by area of a low temperature transformation phase including martensite, bainite, pearlite, and cementite and 0-3% by area of retained austenite, and satisfying above Equation (3).

When the second phase contains a hard phase or structure which is formed by a low temperature transformation such as martensite, bainite, pearlite, and cementite, it becomes possible to increase the strength of steel. In addition, retained austenite has the action of lowering the stretch flangeability of a steel sheet. Therefore, it is possible to guarantee excellent stretch flangeability by limiting the percent by area of retained austenite. Furethermore, by refining the second phase so as to satisfy above Equation (3), the formation and development of fine cracks during working of a steel sheet are suppressed and the stretch flangeability of the steel sheet is increased. The strength of steel is also increased by grain refinement strengthening.

If the total percent by area of a low temperature transformation phase including martensite, bainite, pearlite, and cementite is less than 10%, it is difficult to guarantee a high strength. Accordingly, the total percent by area of a low temperature transformation phase is made at least 10%. It is not necessary for the low temperature transformation phase to contain all of martensite, bainite, pearlite, and cementite, and it is sufficient for it to contain at least one of these phases.

If the percent by area of retained austenite exceeds 3%, it is difficult to guarantee excellent stretch flangeability. Accordingly, the percent by area of retained austenite is made 0-3%. Preferably it is at most 2%.

If the average grain diameter $d_s$ of the second phase does not satisfy above Equation (3), the second phase is not sufficiently fine, and it becomes difficult to guarantee excellent stretch flangeability. In addition, an effect of increasing the strength of steel by grain refinement strengthening is not sufficiently obtained. Accordingly, the average grain diameter $d_s$ of the second phase is made to satisfy above Equation (3).

As explained in greater detail in the examples, the average grain diameter of ferrite which is the main phase is determined using an SEM-EBSD for those ferrite grains which are surrounded by a high angle grain boundary having a tilt angle of at least 15°. SEM-EBSD is a method of carrying out measurement of the orientation of a minute region by electron backscatter diffraction (EBSD) in a scanning electron microscope (SEM). It is possible to measure the grain diameter from the resulting orientation map.

The average grain diameter of the second phase can be determined by counting the number of particles N of the second phase by observation of a cross-section of a steel sheet with an SEM and calculating by equation: $r=(A/N\pi)^{1/2}$ using the percent by area A of the second phase.

The percent by area of the main phase and that of the second phase can be measured by observation of a cross section with an SEM. The percent by area of the retained austenite is the same as the percent by volume determined by X-ray diffraction. By subtracting the percent by area of retained austenite which is determined in this manner from the percent by area of the second phase, it is possible to find the total percent by area of the low temperature transformation phase in the second phase.

In the present invention, the above-described average grain diameter and percent by area are the values measured at a depth of ¼ the sheet thickness of the steel sheet.

Texture: At a depth of ½ the sheet thickness, the average of the X-ray intensities in the {111}<145>, {111}<123>, and {554}<225> orientations is at least 4.0 times the average X-ray intensity of a random structure which does not have a texture By increasing the degree of integration of the {111}<145>, {111}<123>, and {554}<225> orientations at a depth of ½ the sheet thickness in the above manner, the stretch flangeability of the steel sheet is increased. If the average of the X-ray intensities in the {111}<145>, {111}<123>, and {554}<225> orientations is less than 4.0 times the average X-ray intensity of a random structure not having a texture, it is difficult to guarantee excellent stretch flangeability. Accordingly, the cold-rolled sheet is made to have the above-described texture.

The X-ray intensity for a particular orientation is determined by an orientation distribution function (ODF), which is obtained by chemical polishing a steel sheet with hydrofluoric acid to a depth of ½ the sheet thickness, measuring a pole figure for each of the {200}, {111}, and {211} planes of the ferrite phase on the sheet surface, and analyzing the measured values of the pole figure using the series expansion method.

The X-ray intensity of a random structure not having a texture is determined by measurement like that described above using a powdered sample of the steel.

By satisfying the above-described microstructure and texture, a high degree of workability which satisfies the following Equation (8) is obtained for a steel sheet having a tensile strength (TS) of less than 800 MPa. With a steel sheet having a tensile strength (TS) of at least 800 MPa, a high degree of workability which satisfies the following Equation (9) is obtained.

$$3\times TS\times El+TS\times\lambda>105000 \quad (8)$$

$$3\times TS\times El+TS\times\lambda>85000 \quad (9)$$

In the above equations, TS is the tensile strength (MPa), El is the total elongation (elongation at rupture in %), and λ is the percent hole expansion (%) defined in JFS T 1001-1996 of Japan Iron and Steel Federation Standards.

1.3 Plating Layer

With the object of improving corrosion resistance and the like, a plating layer may be provided on the surface of the above-described cold-rolled steel sheet to obtain a surface treated steel sheet. The plating layer may be an electroplated layer or a hot-dip plating layer. Examples of an electroplating are electrogalvanizing and Zn—Ni alloy electroplating. Examples of a hot-dip plating are hot-dip galvanizing, galvannealing, hot-dip aluminum plating, hot-dip Zn—Al alloy plating, hot-dip Zn—Al—Mg alloy plating, and hot-dip Zn—Al—Mg—Si alloy plating. The plating weight is not limited, and it may be a usual value. It is also possible to form a suitable chemical conversion treatment coating on the plating surface (such as one formed by applying a silicate-based chromium-free chemical conversion solution followed by drying) to further improve corrosion resistance. It is also possible to cover the plating with an organic resin coating.

2. Process for Manufacturing a Cold-Rolled Steel Sheet 2.1—Chemical Composition

The chemical composition is as set forth above in 1.1.

2.2—Cold Rolling Step

By subjecting a hot-rolled steel sheet having a fine structure in which there are a large number of high angle grain boundaries so as to satisfy above Equations (5) and (6) to rapid heating annealing following cold rolling, a large amount of fine austenite is formed from the locations which were high angle grain boundaries of the hot-rolled steel sheet in a state in which unrecrystallized ferrite remains. Because the large number of fine austenite grains which are formed restrain recrystallized ferrite grains from growing with crossing the prior grain boundaries of the hot-rolled steel sheet, it is possible to obtain a cold-rolled steel sheet having a fine structure.

When the average grain diameter $d_n$ of ferrite defined by the high angle grain boundaries in a hot-rolled steel sheet which is subject to cold rolling does not satisfy above Equations (5) or (6), even if annealing after cold rolling is performed by rapid heating annealing, the number of nucleus forming sites is small, and a small number of coarse austenite grains are faulted from the deformation texture. The small number of coarse austenite grains contribute almost nothing to suppressing the grain growth of recrystallized ferrite, and the structure of the cold-rolled steel sheet becomes coarse.

Accordingly, the structure of a hot-rolled steel sheet which is to be subjected to cold rolling is made to satisfy above Equations (5) and (6).

In Equation (5), the average grain diameter $d_n$ of ferrite is limited by the contents of C and Mn because as the contents of C and Mn increase, the ductility of a cold-rolled steel sheet decreases. Therefore, by making the structure of a hot-rolled steel sheet which is subjected to cold rolling a finer structure, the structure of the cold-rolled steel sheet becomes finer, and excellent ductility is guaranteed.

The average grain diameter $d_n$ of ferrite in the hot-rolled steel sheet is preferably as small as possible, and therefore there is no particular need to specify a lower limit, but normally it is at least 1.0 μm. Similarly, with respect to a cold-rolled steel sheet, the average grain diameter $d_m$ of ferrite is normally at least 1.0 μm.

Cold rolling can be carried out in a conventional manner There is no particular limit on the reduction in cold rolling (cold rolling reduction), but from the standpoints of promoting recrystallization during annealing and improving the workability of a cold-rolled steel sheet, it is preferably at least 30%. From the standpoint of decreasing the load on cold rolling equipment, it is preferably at most 85%.

From the standpoint of suppressing accumulation of excessive strains in the surface due to friction and preventing abnormal grain growth in the surface at the time of annealing, cold rolling may be carried out using lubricating oil.

2.3—Annealing Step

A cold-rolled steel sheet which is obtained by the above-described cold rolling step is subjected to annealing by heating to a temperature range of at least ($Ae_1$ point+10° C.) to at most ($0.95\times Ae_3$ point+$0.05\times Ae_1$ point) under the conditions that the percent by area of ferrite which remains unrecrystallized when the temperature reached ($Ae_1$ point+10° C.) is at least 30% by area, and then holding in the temperature range for at least 30 seconds.

If the annealing temperature is lower than ($Ae_1$ point+10° C.), a large amount of austenite grains for suppressing growth of the crystallized grains are not formed, and it is difficult to obtain a cold-rolled steel sheet having a fine structure, which is the object of the present invention. Accordingly, the annealing temperature is made at least ($Ae_1$ point+10° C.). Preferably it is at least ($Ae_1$ point+30° C.).

On the other hand, if the annealing temperature is higher than ($0.95\times Ae_3$ point+$0.05\times Ae_1$ point), sudden growth of austenite grains may occur, thereby coarsening the final structure. In particular, since annealing is carried out for at least 30 seconds in order to guarantee manufacturing stability, coarsening of the structure easily progresses. Accordingly, the annealing temperature is made at most ($0.95\times Ae_3$ point+$0.05\times Ae_1$ point). Preferably it is at most ($0.8\times Ae_3$ point+$0.2\times Ae_1$ point).

Heating to the annealing temperature is carried out by rapid heating. The heating conditions at this time are based on the above-described new findings. Since these findings are obtained from the result of below-described Example 2, this point will next be described in detail.

FIG. 1 shows the average grain diameter $d_m$ of ferrite of a cold-rolled steel sheet as a function of the rate of temperature increase at the time of annealing for some of the cold-rolled steel sheets of steel types A-C shown in Table 5. As shown in FIG. 1, as the rate of temperature increase becomes higher, the average grain diameter of ferrite of a cold-rolled steel sheet decreases. As stated above, as the average grain diameter of ferrite of a cold-rolled steel sheet decreases, the tensile strength of the steel sheet increases.

Figure 2:
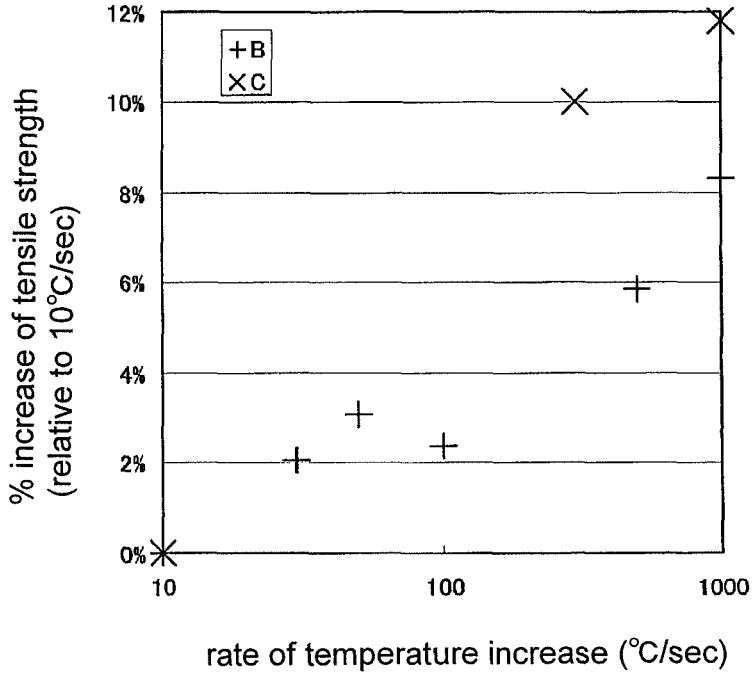
FIG. 2 is a graph showing the relationship between the tensile strength of a cold-rolled steel sheet and the rate of temperature increase for cold-rolled steel sheets made of steel types B and C which were used in the examples and which were annealed by heating to 750° C. at various rates of temperature increase and holding for 60 seconds at that temperature, with the ordinate showing the percent increase in the tensile strength compared to when the rate of temperature increase was 10° C. per second.

In this connection, FIG. 2 shows the relationship between the percent increase in the tensile strength relative to the tensile strength when the rate of temperature increase was 10° C. per second and the rate of temperature increase at the time of annealing. As shown in FIG. 2, if the rate of temperature increase is at least 50° C. per second, an increase in tensile strength of at least 2% is stably achieved. Namely, if the rate of temperature increase is 50° C. per second, the effect attributed to an increase in the rate of temperature increase can be stably achieved.

The higher the rate of temperature increase at the time of annealing of a cold-rolled steel sheet, the higher the proportion of ferrite which remains unrecrystallized (the percentage of unrecrystallized ferrite) when the annealing temperature is reached. As a result of an investigation with respect to the relationship between the rate of temperature increase and the percentage of unrecrystallized ferrite at a temperature of ($Ae_1$ point+10° C.), it was found that the percentage of unrecrystallized ferrite was at least 30% by area when the rate of temperature increase was at least 50° C. per second. In other words, by elevating the temperature to the above-described annealing temperature range under such conditions that the percent of unrecrystallized ferrite at a temperature of ($Ae_1$ point+10° C.) is at least 30% by area, the effect of refining the structure formed by performing cold rolling and subsequent rapid heating annealing on a hot-rolled steel sheet having a fine structure can be stably obtained.

Accordingly, a cold-rolled steel sheet obtained by the above-described cold rolling step is heated to a temperature range for annealing which is at least ($Ae_1$ point+10° C.) by rapid heating which satisfy the conditions that the percentage of unrecrystallized ferrite at a temperature of ($Ae_1$ point+10° C.) is at least 30% by area. There is no particular upper limit on the percentage of unrecrystallized ferrite at this time. If the percent of unrecrystallized ferrite when reaching a temperature of ($Ae_1$ point+10° C.) is less than 30%, it is difficult to stably obtain the effect of refining the structure when cold rolling and rapid heating annealing are carried out on a hot-rolled steel sheet having a fine structure. It is sufficient to carry out rapid heating annealing until the temperature reaches ($Ae_1$ point+10° C.) at which ferrite and austenite begin to coexist, and following this temperature, heating may be slow heating or isothermal temperature holding.

Since the rate of temperature increase is a means of adjusting the percentage of unrecrystallized ferrite at the temperature of ($Ae_1$ point+10° C.), it is not necessary to restrict the rate of temperature increase, but it is preferably at least 50° C. per second, more preferably at least 80° C. per second, particularly preferably at least 150° C. per second, and most preferably at least 300° C. per second. There is no particular upper limit on the rate of temperature increase, but from the standpoint of controlling the annealing temperature, it is preferably at most 1500° C. per second.

The above-described rapid heating can start from a temperature before reaching the recrystallization starting temperature. Specifically, if the temperature for the start of softening which is measured at a rate of temperature increase of 10° C. per second is Ts, it is sufficient to start rapid heating from (Ts−30° C.). In actuality, it is sufficient to start rapid heating from 600° C., and the rate of temperature increase before reaching this temperature can be any desired value. Even if rapid heating is started from room temperature, it does not have an adverse effect on the cold-rolled steel sheet after annealing.

There is no particular limit on a heating method as long as the necessary rate of temperature increase can be achieved. It is preferable to use resistance heating or induction heating, but as long as the above-described temperature increase conditions are satisfied, it is also possible to use heating by a radiant tube. By using such a heating device, the time for heating a steel sheet is greatly decreased, and it is possible to make annealing equipment more compact, whereby effects such as a decrease in investment in equipment can be expected. It is also possible to add a heating device to an existing continuous annealing line or a hot-dip plating line.

When the annealing temperature is a temperature range of at least ($Ae_1$ point+10° C.) to at most ($0.95\times Ae_3$ point+$0.05\times Ae_1$ point), if the annealing time is less than 30 seconds, recrystallization is not completed, and most of the grain boundaries in the structure are constituted by small angle grain boundaries with a tilt angle of at most 15° or a state occurs in which dislocations which are introduced by cold rolling remain. In this case, the workability of a cold-rolled steel sheet markedly decreases. Accordingly, in order to sufficiently promote recrystallization, the annealing time is made at least 30 seconds. Preferably it is at least 45 seconds and more preferably at least 60 seconds.

It is not necessary to restrict an upper limit on the annealing time, but from the standpoint of suppressing coarsening of recrystallized ferrite grains with greater certainty, it is preferably made less than 10 minutes.

Figure 3:
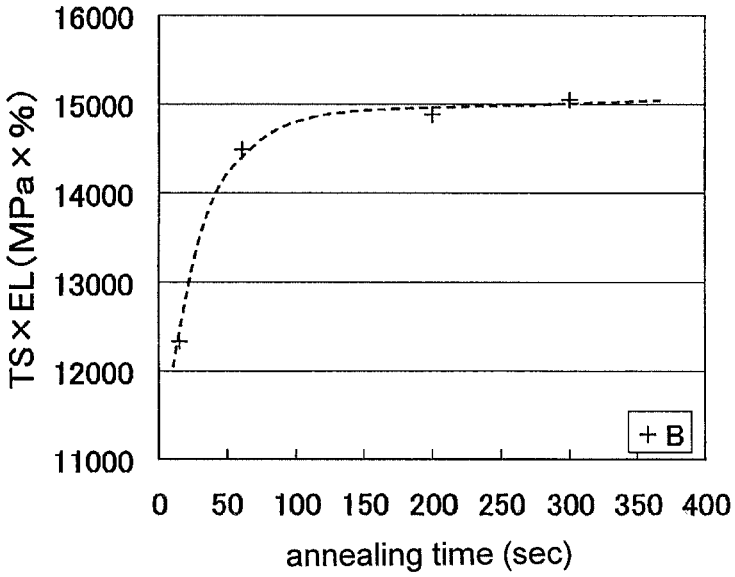
FIG. 3 is a graph showing the relationship between the value of TS×EL (tensile strength multiplied by total elongation) and the holding time during annealing for steel B which was used in the examples and which was annealed by heating to 750° C. at 500° C. per second and then soaking (temperature holding) for from 15 seconds to 300 seconds followed by cooling to room temperature at 50° C. per second.

FIG. 3 shows the change in the value of TS×El as a function of the holding time for annealing when a cold-rolled steel sheet made of steel type B of Example 2 shown in Table 5 was annealed by heating to 750° C. at a rate of temperature increase of 500° C. per second and then holding for 15-300 seconds. From this result, it can be seen that even if a cold-rolled steel sheet according to the present invention has a long annealing time of around 300 seconds, grain growth is suppressed and stable material properties are obtained. On the other hand, if the annealing time is less than 30 seconds, the structure of the steel sheet does not complete recrystallization, and an increase in the grain diameter still progresses, or the phase transformation does not reach an equilibrium state with the transformation in structure remaining in an intermediate state. As a result, workability (elongation) is poor, and in actual operation, it becomes difficult to stably obtain a uniform structure.

Cooling after annealing can be carried out at a desired cooling rate, and by controlling the cooling rate, it is possible to precipitate a second phase such as pearlite, bainite, or martensite in the steel. The cooling method can be any desired method. For example, cooling with a gas, a mist, or water is possible. After cooling from the annealing temperature to an appropriate temperature, overaging heat treatment may be performed by supplemental reheating, if necessary, and holding at a temperature of at least 200° C. and at most 600° C. Alternatively, after cooling the annealed steel sheet to an appropriate temperature, it can be subjected to surface treatment such as plating. Specifically, a steel sheet which has undergone annealing can be subjected to hot-dip galvanizing, galvannealing (hot-dip galvanizing followed by annealing for alloying), or electrogalvanizing to obtain a galvanized (zinc-plated) steel sheet.

2.3—Hot Rolling Step

A hot-rolled steel sheet which is subjected to cold rolling has a microstructure which satisfies the conditions stated in the section on cold rolling, namely, it has the above-described chemical composition and a microstructure satisfying above Equations (5) and (6). There are no particular limitations on a manufacturing method of the hot-rolled steel sheet which is used, but preferably it has excellent thermal stability. A preferred hot-rolled steel sheet can be manufactured by a hot rolling step in which a slab having the above-described chemical composition undergoes hot rolling with rolling being completed at the $Ar_3$ point or above, and then within 0.4 seconds of the completion of rolling it is cooled to a temperature range of at most 750° C. at an average cooling rate of at least 400° C. per second.

By employing such a hot rolling step, the strains which have been introduced into austenite during rolling can be prevented from being consumed by recovery and recrystallization as much as possible. As a result, strain energy accumulated in the steel can be used to the maximum extent as a driving force for transformation from austenite to ferrite, resulting in the formation of an increased amount of nuclei for transformation from austenite to ferrite, thereby refining the structure of the hot-rolled steel sheet and imparting excellent thermal stability to the structure.

By subjecting a hot-rolled steel sheet which is manufactured in this manner to cold rolling and then the above-described annealing, refinement of a cold-rolled steel sheet can be effectively achieved.

From the standpoint of productivity, a slab which is subjected to hot rolling is preferably manufactured by continuous casting. The slab may be used in a high temperature state after continuous casting, or it may be first cooled to room temperature and then reheated. From the standpoints of reducing the load on rolling equipment and easily guaranteeing the temperature at the completion of rolling, the temperature of the slab which is subjected to hot rolling is preferably at least 1000° C. From the standpoint of suppressing a decrease in yield due to scale loss, the temperature of a slab which is subjected to hot rolling is preferably at most 1400° C.

Hot rolling is preferably carried out using a reversing mill or a tandem mill. From the standpoint of industrial productivity, it is preferable to use a tandem mill for at least the final number of stands.

During rolling, because it is necessary to maintain the steel sheet in an austenite temperature range, the temperature at the completion of rolling is made at least the $Ar_3$ point. In order to suppress as much as possible thermal recovery of working strains which are introduced into austenite, the temperature at the completion of rolling is preferably just above the $Ar_3$ point and specifically at most ($Ar_3$ point+50° C.).

The rolling reduction in hot rolling is preferably such that the percent reduction in the sheet thickness when the slab temperature is in the temperature range from the $Ar_3$ point to ($Ar_3$ point+100° C.) is at least 40%. The percent reduction in thickness in this temperature range is more preferably at least 60%.

It is not necessary to carry out rolling in one pass, and rolling may be carried out by a plurality of sequential passes. Increasing the rolling reduction is preferable because it can introduce a larger amount of strain energy into austenite, thereby increasing the driving force for ferrite transformation and refining ferrite more greatly. However, doing so increases the load on rolling equipment, so the upper limit on the rolling reduction per pass is preferably 60%.

As stated above, cooling after the completion of rolling is preferably carried out by cooling to a temperature range of 750° C. or below at an average cooling rate of at least 400° C. per second within 0.4 seconds of the completion of rolling.

It is more preferable to further shorten the time required for cooling from the completion of rolling to 750° C. or below, to further increase the cooling rate, and to cool to a lower temperature since it can more greatly refine the structure of the hot-rolled steel sheet. Specifically, the time for cooling from the completion of rolling to a temperature range of 750° C. or below is preferably made at most 0.2 seconds. The average cooling rate at the time of cooling within 0.4 seconds after the completion of rolling to a temperature range of 750° C. or below is preferably made at least 600° C. per second and is particularly preferably at least 800° C. per second. Cooling within 0.4 seconds after the completion of rolling to a temperature range of 720° C. or below at an average cooling rate of at least 400° C. is still more preferable. The temperature range for cooling is preferably at least the $M_s$ point. The cooling method is preferably water cooling.

After carrying out the above-described cooling, the steel sheet may be held at a temperature of 600-720° C. for a desired length of time to allow ferrite transformation to proceed and control the percent by area of ferrite in the structure. In order to sufficiently form equiaxial grains of ferrite in the hot-rolled steel sheet, it is preferable to hold the steel sheet for at least 3 seconds at a temperature of 600-720° C.

Then, until the steel sheet is coiled, cooling can be carried out at a desired cooling rate by water cooling, mist cooling, or gas cooling. The steel sheet can be coiled at a desired temperature.

The structure of the hot-rolled steel sheet which is subjected to cold rolling preferably has ferrite as a main phase, and it may contain at least one hard phase selected from pearlite, bainite, and martensite as a second phase.

2.5—Plating

With the object of improving corrosion resistance and the like, a plating layer like that described above may be formed on the surface of the cold-rolled steel sheet which is obtained by the above-described manufacturing process to form a surface treated steel sheet. Plating can be carried out in a conventional manner. Following plating, a suitable chemical conversion treatment may be carried out.

Example 1

This example illustrates cold-rolled steel sheets according to the present invention.

Ingots of steel types AA-AN having the chemical compositions shown in Table 1 were prepared by melting in a vacuum induction furnace. Table 1 shows the $Ae_1$ point and the $Ae_3$ point of each steel type. These transformation temperatures were determined from a thermal expansion chart measured when a steel sheet which was cold rolled under the below-described manufacturing conditions was heated to 1000° C. at a rate of temperature increase of 5° C. per second. Table 1 also shows the values of ($Ae_1$ point+10° C.) and ($0.05Ae_1$ $0.95\ Ae_3$) and the calculated values of the right sides of above-described Equations (1) and (5).

The right side of Equation (1) or $E_1=2.7+10000/(5+300\times C+50\times Mn+4000\times Nb+2000\times Ti+400\times V)^2$.

The right side of Equation (5) or $E_5=2.5+6000/(5+350\times C+40\times Mn)^2$.

TABLE 1

| Steel | Chemical Composition (mass %) | | | | | | | | | Right side of equation | | $Ae_1$ | $Ae_3$ | $Ae_1$ + 10 | $0.95Ae_3$ + $0.05Ae_1$ |
|---|---|---|---|---|---|---|---|---|---|---|---|---|---|---|---|
| type | C | Si | Mn | P | S | Ti | Nb | sol. Al | Others | (1) | (5) | (° C.) | (° C.) | (° C.) | (° C.) |
| AA | 0.108 | 0.05 | 1.48 | 0.005 | 0.001 | — | — | — | — | 3.506 | 3.077 | 703 | 838 | 713 | 831.25 |
| AB | 0.102 | 0.05 | 1.27 | 0.005 | 0.001 | — | — | — | 0.3Cr | 3.718 | 3.217 | 698 | 841 | 708 | 833.85 |
| AC | 0.148 | 0.05 | 0.78 | 0.015 | 0.002 | — | — | — | — | 3.98 | 3.275 | 707 | 845 | 717 | 838.1 |
| AD | 0.059 | 0.51 | 2.51 | 0.01 | 0.001 | — | 0.010 | — | — | 2.982 | 2.878 | 701 | 821 | 711 | 815 |
| AE | 0.038 | 0.51 | 2.49 | 0.01 | 0.001 | — | — | — | 0.0022Ca | 3.204 | 2.932 | 695 | 835 | 705 | 828 |
| AF | 0.059 | 0.5 | 1.98 | 0.013 | 0.002 | — | 0.010 | — | 0.2Mo | 3.082 | 3.046 | 703 | 827 | 713 | 820.8 |
| AG | 0,068 | 0.04 | 0.37 | 0.017 | 0.002 | — | — | — | — | 7.889 | 5.656 | 715 | 872 | 725 | 864.15 |

TABLE 1-continued

| Steel | Chemical Composition (mass %) | | | | | | | | | Right side of equation | | $Ae_1$ | $Ae_3$ | $Ae_1 + 10$ | $0.95Ae_3 + 0.05Ae_1$ |
|---|---|---|---|---|---|---|---|---|---|---|---|---|---|---|---|
| type | C | Si | Mn | P | S | Ti | Nb | sol. Al | Others | (1) | (5) | (° C.) | (° C.) | (° C.) | (° C.) |
| AH | 0.062 | 1.47 | 3.15 | 0.004 | 0.001 | 0.03 | — | — | — | 2.872 | 2.757 | 712 | 872 | 722 | 864 |
| AI | 0.073 | 0.51 | 2.76 | 0.004 | 0.001 | — | 0.003 | — | 0.1V | 2.913 | 2.802 | 701 | 845 | 711 | 837.8 |
| AJ | 0.077 | 0.50 | 2.78 | 0.004 | 0.001 | — | — | — | 0.1V | 2.933 | 2.793 | 695 | 839 | 705 | 831.8 |
| AK | 0.059 | 0.50 | 3.34 | 0.004 | 0.001 | — | 0.009 | 0.492 | — | 2.896 | 2.737 | 702 | 882 | 712 | 873 |
| AL | 0.078 | 0.51 | 2.95 | 0.002 | 0.001 | — | 0.052 | — | — | 2.768 | 2.766 | 712 | 880 | 722 | 871.6 |
| AM | 0.081 | 0.49 | 2.88 | 0.002 | 0.001 | — | 0.010 | — | 0.0019REM | 2.92 | 2.772 | 704 | 872 | 714 | 863.6 |
| AN | 0.121 | 0.51 | 1.92 | 0.006 | 0.001 | 0.015 | — | — | 0.0009B | 3.057 | 2.889 | 702 | 852 | 712 | 844.5 |

Underlining indicates values outside the range of the present invention.

The resulting ingots underwent hot forging, and then they were cut to the shape of slabs in order to subject them to hot rolling. These slabs were heated for approximately one hour to a temperature of at least 1000° C., and then hot rolling and cooling were carried out using a small test mill with the temperature at the completion of rolling, the cooling time from the completion of rolling to 750° C., the cooling rate (water cooling), and the coiling temperature shown in Table 2 to manufacture hot-rolled steel sheets having a thickness of 1.5-3.0 mm.

The average grain diameter d of ferrite in each hot-rolled steel sheet is shown in Table 2. The grain diameter of ferrite in a hot-rolled steel sheet was measured on a cross section in a widthwise direction at a depth of ¼ of the thickness of the steel sheet using an SEM-EBSD apparatus (model JSM-7001F manufactured by JEOL Ltd.) and determined by analyzing the grains defined by high angle grain boundaries having a tilt angle of at least 15°.

The resulting hot-rolled steel sheets were pickled with a hydrochloric acid is solution and subjected to cold rolling with the cold rolling reduction shown in Table 2 (each at least 30%) to reduce the sheet thickness of the steel sheets to 0.6 mm-1.0 mm, and then annealing was carried out thereon with the heating rate (rate of temperature increase), annealing temperature (soaking temperature), and holding time for annealing (soaking time) shown in Table 2 using a laboratory scale annealing apparatus to obtain cold-rolled steel sheets. Cooling after soaking was carried out with helium gas.

TABLE 2

| | | Hot rolling conditions | | | | | Cold rolling/annealing conditions | | | |
|---|---|---|---|---|---|---|---|---|---|---|
| Steel sheet No. | Steel type | Temp. at completion (° C.) | Cooling time[1)] (sec) | Rate of water cooling (° C./sec) | Coiling temp. (° C.) | $d_n$ (μm) | Cold rolling reduction (%) | Heating rate (° C./sec) | Annealing temp. (° C.) | Holding time for annealing (sec) |
| A1 | AA | 840 | 0.070 | 1300 | RT | 2.0 | 60 | 10 | 800 | 30 |
| A2 | AA | 840 | 0.070 | 1300 | RT | 2.0 | 60 | 300 | 800 | 30 |
| A3 | AA | 840 | 0.070 | 1300 | RT | 2.0 | 60 | 300 | 740 | 30 |
| A4 | AB | 840 | 0.070 | 1300 | RT | 1.9 | 60 | 10 | 800 | 30 |
| A5 | AB | 840 | 0.070 | 1300 | RT | 1.9 | 60 | 100 | 800 | 30 |
| A6 | AC | 850 | 0.123 | 885 | RT | 2.1 | 50 | 10 | 800 | 60 |
| A7 | AC | 850 | 0.123 | 885 | RT | 2.1 | 50 | 100 | 800 | 60 |
| A8 | AC | 860 | 8.000 | 130 | RT | 6.4 | 50 | 10 | 800 | 60 |
| A9 | AC | 860 | 8.000 | 130 | RT | 6.4 | 50 | 500 | 800 | 60 |
| A10 | AD | 810 | 0.065 | 930 | RT | 2.3 | 55 | 500 | 800 | 30 |
| A11 | AE | 810 | 0.065 | 930 | 550 | 1.9 | 55 | 10 | 800 | 30 |
| A12 | AE | 810 | 0.065 | 930 | 550 | 1.9 | 55 | 500 | 800 | 30 |
| A13 | AF | 810 | 0.065 | 930 | RT | 2.5 | 55 | 10 | 800 | 60 |
| A14 | AF | 810 | 0.065 | 930 | RT | 2.5 | 55 | 500 | 800 | 60 |
| A15 | AG | 850 | 0.123 | 885 | RT | 3.2 | 50 | 10 | 800 | 60 |
| A16 | AG | 850 | 0.123 | 885 | RT | 3.2 | 50 | 100 | 800 | 60 |
| A17 | AH | 820 | 0.076 | 920 | RT | 1.8 | 55 | 10 | 820 | 30 |
| A18 | AH | 820 | 0.076 | 920 | RT | 1.8 | 55 | 100 | 820 | 30 |
| A19 | AI | 810 | 0.072 | 840 | RT | 2.1 | 55 | 10 | 800 | 30 |
| A20 | AI | 810 | 0.072 | 840 | RT | 2.1 | 55 | 500 | 800 | 30 |
| A21 | AJ | 810 | 0.072 | 840 | RT | 2.3 | 55 | 10 | 800 | 30 |
| A22 | AJ | 810 | 0.072 | 840 | RT | 2.3 | 55 | 500 | 800 | 30 |
| A23 | AK | 810 | 0.072 | 840 | RT | 2.0 | 55 | 10 | 800 | 30 |
| A24 | AK | 810 | 0.072 | 840 | RT | 2.0 | 55 | 500 | 800 | 30 |
| A25 | AK | 810 | 0.072 | 840 | 550 | 2.0 | 55 | 10 | 800 | 30 |
| A26 | AK | 810 | 0.072 | 840 | 550 | 2.0 | 55 | 500 | 800 | 30 |
| A27 | AL | 810 | 0.072 | 840 | 550 | 2.2 | 55 | 10 | 760 | 30 |
| A28 | AL | 810 | 0.072 | 840 | 550 | 2.2 | 55 | 500 | 760 | 30 |
| A29 | AM | 810 | 0.072 | 840 | RT | 2.2 | 55 | 10 | 800 | 30 |
| A30 | AM | 810 | 0.072 | 840 | RT | 2.2 | 55 | 500 | 800 | 30 |

TABLE 2-continued

| Steel sheet No. | Steel type | Hot rolling conditions: Temp. at completion (° C.) | Cooling time[1)] (sec) | Rate of water cooling (° C./sec) | Coiling temp. (° C.) | $d_n$ (μm) | Cold rolling/annealing conditions: Cold rolling reduction (%) | Heating rate (° C./sec) | Annealing temp. (° C.) | Holding time for annealing (sec) |
|---|---|---|---|---|---|---|---|---|---|---|
| A31 | AN | 820 | 0.084 | 840 | RT | 2.1 | 55 | 10 | 780 | 30 |
| A32 | AN | 820 | 0.084 | 840 | RT | 2.1 | 55 | 500 | 780 | 30 |

Underlining indicates values outside the range of the present invention.
RT = room temperature
[1)]Cooling time from completion of rolling to 750° C.

The microstructure and mechanical properties of the cold-rolled steel sheets which were manufactured in this manner were investigated as follows.

The average grain diameter $d_m$ of ferrite of the cold-rolled steel sheets was determined in the same manner as described with respect to the hot-rolled steel sheets by analyzing the structure of a cross section in the widthwise direction at a depth of ¼ of the thickness of a steel sheet using an SEM-EBSD apparatus. The average grain diameter $d_s$ of the second phase was determined by calculating the equation: $r=(A/N\pi)^{1/2}$ from the number of grains N of the second phase and the area A of the second phase measured on the structure of a cross section in the widthwise direction at a depth of ¼ of the thickness of a steel sheet.

The percent by area of ferrite and the percent by area of the second phase which was a phase other than ferrite were determined by the point count method in an SEM photograph take in the widthwise direction of a cross section at a depth of ¼ of the thickness of the steel sheet. The percent by volume of the austenite phase was determined by X-ray diffractometry, and this value was taken as the percent by area of retained austenite (retained γ). By subtracting this percent by area from the above-described percent by area of the second phase, the percent by area of the low temperature transformation phase which was the hard second phase was determined. This low temperature transformation phase contained at least one of martensite, bainite, pearlite, and cementite.

Measurement of the texture of the cold-rolled steel sheets was carried out by X-ray diffractometry on a plane at a depth of ½ of the sheet thickness of a steel sheet. The average of the X-ray intensities in three orientations, i.e., {111}<145>, {111}<123>, and {554}<225> orientations was determined using ODF (orientation distribution function) which was obtained by analyzing the measured results of pole figures of {200}, {110}, and {211} of ferrite. Separately, the average X-ray intensity of a random structure not having a texture was determined by X-ray diffraction of a powdered steel. The ratio of the average X-ray intensities in the above-described three orientations to the average X-ray intensity of the random structure was calculated, and this ratio was made the average X-ray intensity. The apparatus which was used was a RINT-2500HL/PC manufactured by Rigaku Corporation.

The mechanical properties of the cold-rolled steel sheet after annealing were investigated by a tensile test and a hole expanding test. The tensile test was carried out using a half-size ASTM tensile test piece, and the yield strength, the tensile strength (TS) and the elongation at rupture (total elongation El) were determined. The hole expanding test was carried out by expanding a hole with a punched diameter $d_0$ of 10 mm using a conical punch having a peak angle of 60°, and the percent hole expansion λ (%) was determined from the hole diameter $d_1$ at the time when a crack formed at the edge surface of the punched hole reached both surfaces of the sheet as $\lambda=(d_1-d_0)/d_0\times100$.

Table 3 shows the results of investigation of the structure and the mechanical properties of the cold-rolled steel sheets. Compliance with Equations (1)-(4) is shown by the mark ○ (compliance with all equations) or ×(lack of compliance with at least one equation).

TABLE 3

| Steel sheet No. | Structure of cold-rolled steel sheet: % by area of ferrite | % by area of low temp. transformation phase | % by volume of retained γ | $d_m$ (μm) | $d_s$ (μm) | Average X-ray intensity* | Mechanical properties of cold-rolled steel sheet**: YS (MPa) | TS (MPa) | El (%) | λ (%) | TS × El (MPa × %) | TS × λ (MPa × %) | Compliance with Equations (1)-(4) | Category |
|---|---|---|---|---|---|---|---|---|---|---|---|---|---|---|
| A1 | 83 | 17 | 0 | 3.6 | 1.7 | 3.9 | 446.0 | 541.5 | 24.6 | 105.2 | 13321 | 56966 | x | Comparative |
| A2 | 83 | 17 | 0 | 2.9 | 0.7 | 4.3 | 474.0 | 558.5 | 25.8 | 114.4 | 14409 | 63892 | ○ | Inventive |
| A3 | 83 | 17 | 0 | 2.1 | 0.4 | 4.6 | 550.5 | 595.0 | 22.8 | 109.2 | 13566 | 64974 | ○ | Inventive |
| A4 | 87 | 13 | 0 | 3.8 | 2.1 | 3.5 | 452.0 | 553.0 | 23.1 | 106.6 | 12774 | 58950 | x | Comparative |
| A5 | 87 | 13 | 0 | 2.9 | 0.8 | 4.5 | 488.0 | 573.0 | 24.0 | 112.3 | 13752 | 64348 | ○ | Inventive |
| A6 | 86 | 14 | 0 | 4.8 | 1.6 | 3.5 | 372.0 | 458.5 | 37.0 | 114.0 | 16965 | 52269 | x | Comparative |
| A7 | 87 | 13 | 0 | 3.4 | 0.9 | 4.3 | 404.5 | 480.0 | 37.2 | 123.7 | 17856 | 59376 | ○ | Inventive |
| A8 | 85 | 15 | 0 | 7.3 | 2.3 | 2.5 | 374.5 | 459.5 | 36.0 | 112.5 | 16542 | 51694 | x | Comparative |
| A9 | 86 | 14 | 0 | 6.9 | 2.1 | 2.6 | 392.0 | 466.5 | 34.8 | 110.1 | 16234 | 51362 | x | Comparative |
| A10 | 81 | 19 | 0 | 2.5 | 0.9 | 4.6 | 474.0 | 715.0 | 27.6 | 92.7 | 19734 | 66281 | ○ | Inventive |
| A11 | 87 | 13 | 0 | 3.3 | 1.7 | 3.5 | 423.0 | 610.0 | 26.5 | 88.2 | 16165 | 53802 | x | Comparative |
| A12 | 87 | 13 | 0 | 2.6 | 0.8 | 4.7 | 438.0 | 628.0 | 26.6 | 95.3 | 16705 | 59848 | ○ | Inventive |
| A13 | 78 | 22 | 0 | 3.5 | 2.1 | 3.0 | 449.0 | 633.0 | 26.3 | 73.4 | 16648 | 46462 | x | Comparative |
| A14 | 80 | 20 | 0 | 2.5 | 1.1 | 4.3 | 462.0 | 659.0 | 26.9 | 81.2 | 17727 | 53511 | ○ | Inventive |
| A15 | 93 | 7 | 0 | 7.4 | 2.4 | 2.9 | 333.0 | 412.5 | 39.8 | 112.0 | 16418 | 46200 | x | Comparative |

TABLE 3-continued

| Steel sheet No. | Structure of cold-rolled steel sheet: % by area of ferrite | % by area of low temp. transformation phase | % by volume of retained γ | $d_m$ (μm) | $d_s$ (μm) | Average X-ray intensity* | Mechanical properties of cold-rolled steel sheet**: YS (MPa) | TS (MPa) | El (%) | λ (%) | TS × El (MPa × %) | TS × λ (MPa × %) | Compliance with Equations (1)-(4) | Category |
|---|---|---|---|---|---|---|---|---|---|---|---|---|---|---|
| A16 | 92 | 8 | 0 | 6.4 | 2.3 | 4.4 | 337.5 | 422.0 | 39.8 | 113.2 | 16796 | 47770 | x | Comparative |
| A17 | 53 | 46 | 1 | 3.6 | 1.9 | 3.2 | 580.0 | 949.0 | 14.8 | 38.0 | 14045 | 36062 | x | Comparative |
| A18 | 54 | 45 | 1 | 2.5 | 0.9 | 4.9 | 597.0 | 981.0 | 17.1 | 44.1 | 16775 | 43262 | ○ | Inventive |
| A19 | 68 | 30 | 2 | 3.3 | 1.6 | 3.4 | 741.0 | 888.0 | 15.4 | 48.0 | 13675 | 42624 | x | Comparative |
| A20 | 71 | 27 | 2 | 2.4 | 0.7 | 5.0 | 738.5 | 891.5 | 17.5 | 55.1 | 15566 | 49122 | ○ | Inventive |
| A21 | 71 | 27 | 2 | 3.5 | 1.7 | 3.6 | 758.5 | 895.0 | 14.8 | 49.5 | 13246 | 44303 | x | Comparative |
| A22 | 73 | 25 | 2 | 2.4 | 0.9 | 4.9 | 758.5 | 905.5 | 15.6 | 58.0 | 14126 | 52519 | ○ | Inventive |
| A23 | 62 | 37 | 1 | 3.1 | 1.7 | 3.2 | 735.5 | 851.0 | 15.8 | 40.3 | 13446 | 34295 | x | Comparative |
| A24 | 66 | 33 | 1 | 2.2 | 1.0 | 4.9 | 724.5 | 874.0 | 17.3 | 47.2 | 15120 | 41253 | ○ | Inventive |
| A25 | 53 | 45 | 2 | 3.0 | 1.8 | 2.4 | 701.0 | 890.0 | 15.4 | 45.3 | 13706 | 40317 | x | Comparative |
| A26 | 53 | 45 | 2 | 2.2 | 1.1 | 5.3 | 673.5 | 887.0 | 16.2 | 51.0 | 14369 | 45237 | ○ | Inventive |
| A27 | 43 | 56 | 1 | 2.7 | 1.8 | 3.8 | 666.5 | 1006.0 | 13.2 | 25.0 | 13279 | 25150 | x | Comparative |
| A28 | 47 | 52 | 1 | 2.4 | 1.1 | 4.7 | 684.5 | 1027.5 | 12.0 | 22.8 | 12330 | 23427 | ○ | Comparative |
| A29 | 76 | 22 | 2 | 3.6 | 1.9 | 3.2 | 608.5 | 893.5 | 15.4 | 47.0 | 13760 | 41995 | x | Comparative |
| A30 | 81 | 17 | 2 | 2.4 | 0.8 | 4.8 | 708.5 | 915.0 | 16.4 | 52.3 | 15006 | 47855 | ○ | Inventive |
| A31 | 68 | 31 | 1 | 3.6 | 1.8 | 3.1 | 543.0 | 812.5 | 19.8 | 33.1 | 16088 | 26894 | x | Comparative |
| A32 | 65 | 34 | 1 | 2.6 | 1.1 | 5.4 | 568.2 | 823.1 | 21.5 | 41.3 | 17697 | 33994 | ○ | Inventive |

*Average X-ray intensity in {111}<145>, {111}<123>, and {554}<225> orientations.
**YS = yield strength, TS = tensile strength, El = total elongation, λ = % hole expansion Of steel sheets Nos. A1-A3 manufactured from steel type AA, with A2 and A3 in which a hot-rolled steel sheet with a grain diameter of less than 3.5 μm was used as a starting material and the heating rate at the time of annealing was at least 50° C. per second, cold-rolled steel sheets having a microstructure according to the present invention were obtained. On the other hand, with A1, due to the heating rate at the time of annealing which was low, the grain diameter of ferrite and that of the second phase in the cold-rolled steel sheet were coarse, and the average X-ray intensity in the above orientations which is an indicator of a texture was less than 4. As a result, with A2 and A3 which were examples of the present invention, a high to degree of workability which satisfied above Equation (8) was obtained.

Similar results were obtained for the other steel types. Based on whether the tensile strength (TS) was less than 800 MPa or at least 800 MPa, a high degree of workability which satisfied Equation (8) or Equation (9) was obtained. With A10, A13, A14, A17-A20, A23-A26, and A29-A32 to which one or more of Nb, Ti, and V were added, when the heating rate was at least 50° C. per second, the ferrite grain diameter satisfied Equation (4) (less than 3.5 μm), and a cold-rolled steel sheet having a preferred microstructure was obtained.

In contrast, with A8 and A9, due to the hot-rolled steel sheets used as a starting material which had coarse grains with a grain diameter of 6.4 μm, in spite of carrying out annealing by rapid heating, the microstructure of the cold-rolled steel sheets coarsened, and the average grain diameter of ferrite and the average grain diameter of the second phase both exceeded the upper limits defined by the present invention. In addition, the X-ray intensity of the texture fell below 4.0. As a result, the mechanical properties were insufficient.

A15 and A16 had an Mn content of 0.37%, and the cold-rolled steel sheet had coarse grains because suppression of grain growth during annealing did not work sufficiently. As a result, good mechanical properties were not obtained.

A27 and A28 had an Nb content of 0.052%, and due to suppression of the formation of recrystallization nuclei during annealing, a deformation texture remained in the cold-rolled steel sheet. The extent to which such a deformation texture remained became more marked as the heating rate at the time of annealing increased. As a result, the mechanical properties of the cold-rolled steel sheet were poor regardless of the heating rate.

Example 2

This example illustrates a process for manufacturing a cold-rolled steel sheet according to the present invention.

Ingots of steel types A-K having the chemical compositions shown in Table 4 were prepared by melting in a vacuum induction furnace. The resulting ingots were hot forged and then cut into slabs to be subjected to hot rolling. The slabs were heated for approximately 1 hour at a temperature of at least 1000° C., then they underwent hot rolling using a small test mill with the temperature at the completion of rolling, the cooling time from the completion of rolling to 750° C., the cooling rate (water cooling), the holding time, and the temperature at the termination of rapid cooling shown in Table 5, and then they were cooled to room temperature to manufacture hot-rolled steel sheets having a sheet thickness of 1.5-3.0 mm.

Table 4 shows the $Ae_1$ point and the $Ae_3$ point for each steel type which was determined by the method described in Example 1, the value of ($Ae_1$ point+10° C.), the value of ($0.05Ae_1+0.95Ae_3$), and the calculated values of the right sides of Equation (1) and Equation (5).

TABLE 4

| Steel type | Chemical Composition (mass %) C | Si | Mn | P | S | Ti | Nb | sol. Al | Others | $Ae_1$ (° C.) | $Ae_3$ (° C.) | $Ae_1$ + 10 (° C.) | $0.95Ae_3$ + $0.05Ae_1$ (° C.) | Right side of equation (1) | (5) |
|---|---|---|---|---|---|---|---|---|---|---|---|---|---|---|---|
| A | 0.038 | 0.51 | 2.49 | 0.010 | 0.001 | — | — | 0.031 | | 659 | 812 | 669 | 804 | 3.2 | 2.9 |
| B | 0.096 | 0.04 | 1.02 | 0.017 | 0.002 | — | — | 0.016 | | 708 | 849 | 718 | 842 | 4.1 | 3.5 |
| C | 0.097 | 0.05 | 1.95 | 0.015 | 0.002 | — | — | — | | 685 | 833 | 695 | 826 | 3.3 | 2.9 |
| D | 0.149 | 0.05 | 1.01 | 0.015 | 0.002 | — | — | 0.015 | | 698 | 827 | 708 | 821 | 3.7 | 3.1 |
| E | 0.201 | 0.06 | 1.00 | 0.015 | 0.002 | — | — | 0.017 | Mo: 0.15 | 689 | 816 | 699 | 810 | 3.5 | 3.0 |
| F | 0.059 | 0.51 | 2.49 | 0.010 | 0.002 | — | 0.03 | 0.034 | Ca: 0.0021 REM: 0.0020 | 687 | 825 | 697 | 818 | 2.8 | 2.9 |
| G | 0.059 | 0.50 | 2.78 | 0.016 | 0.002 | — | 0.009 | 0.033 | V: 0.20 | 692 | 829 | 702 | 822 | 2.8 | 2.8 |
| H | 0.118 | 0.51 | 2.51 | 0.010 | 0.002 | — | 0.01 | 0.035 | B: 0.0016 | 685 | 835 | 695 | 828 | 2.9 | 2.8 |
| I | 0.021 | 0.49 | 2.50 | 0.010 | 0.001 | 0.02 | — | 0.036 | | 704 | 841 | 714 | 834 | 3.0 | 3.0 |
| J | 0.175 | 0.51 | 1.98 | 0.018 | 0.001 | — | — | 1.480 | | 711 | 859 | 721 | 852 | 3.1 | 2.8 |
| K | 0.002 | 0.05 | 0.09 | 0.020 | 0.001 | 0.05 | 0.01 | 0.030 | | 887 | 912 | 897 | 911 | 3.1 | 71.9 |

Underlining indicates values outside the range of the present invention.

The average grain diameter $d_n$ of ferrite defined by high angle grain boundaries having a tilt angle of at least 15° of each hot-rolled steel sheet, which was determined in the same manner as described in Example 1, is shown in Table 5.

After the hot-rolled steel sheets were pickled with a hydrochloric acid solution, they underwent cold rolling with a rolling reduction of at least 30% (shown in Table 5) to reduce the thickness of the steel sheets to 0.6-1.4 mm and then annealing using a laboratory-scale annealing apparatus with the heating rate (rate of temperature increase), annealing temperature, and annealing time shown in Table 5 to obtain cold-rolled steel sheets. Cooling after soaking (annealing) was carried out in the same manner as in Example 1.

Table 5 shows the percentage of unrecrystallized ferrite at a temperature of the $Ae_1$ point+10° C. (referred to below simply as the percent unrecrystallized ferrite). This value was determined by the following method. A steel sheet which underwent processing up to cold rolling in accordance with the manufacturing conditions for each steel number was heated to a temperature of around $Ae_1$ point+10° C. (error of ±15° C.) at the heating rate shown for each steel number, and it was immediately cooled by water cooling. The structure was photomicrographed with an SEM, and by measuring the fractions of recrystallized ferrite and deformed ferrite on the resulting photomicrograph of the structure, the percentage of unrecrystallized ferrite was determined as being equal to the fraction of deformed ferrite. As can be seen from Table 5, the percentage of unrecrystallized ferrite correlates to the heating rate during annealing, and when the heating rate is at least 50° C. per second, the percentage of unrecrystallized ferrite becomes at least 40%. In Example 1, the percentage of unrecrystallized ferrite was not measured, but it is certain that it exhibits the same tendency as in Example 2.

The yield strength, tensile strength, and elongation at rupture (total elongation) of the cold-rolled steel sheets which were manufactured in this manner were determined by subjecting a half-size ASTM tensile test piece prepared from each steel sheet to a tensile test. The total elongation was evaluated as acceptable if it is at least 20%. Since the strength of a steel sheet is highly dependent upon its chemical composition, the strength of steel sheets which were manufactured from the same steel types but by different manufacturing processes were compared, and the manufacturing processes were evaluated based on these results. The average grain diameter $d_m$ of ferrite defined by high angle grain boundaries with a tilt angle of at least 15° in the cold-rolled steel sheets after annealing was determined in the same manner as described in Example 1. The results of measurement are shown in Table 5.

TABLE 5

| Steel sheet No. | Steel type | Hot rolling conditions: Finish temp. (° C.) | Cooling time[1)] (sec) | Cooling rate (° C./sec) | Holding time[2)] (sec) | Temp. at end of rapid cooling (° C.) | Average ferrite grain diameter $d_n$ of hot-rolled steel sheet (μm) | Cold rolling/annealing conditions: % reduction in cold rolling | Heating rate (° C./sec) |
|---|---|---|---|---|---|---|---|---|---|
| 1 | A | 810 | 0.07 | 1030 | 9.4 | 660 | 2.5 | 60 | 30 |
| 2 | A | 810 | 0.07 | 1030 | 9.4 | 660 | 2.5 | 60 | 300 |
| 3 | A | 810 | 0.07 | 1030 | 9.4 | 660 | 2.5 | 60 | 1000 |
| 4 | A | 810 | 0.07 | 1030 | 9.4 | 660 | 2.5 | 60 | 1000 |
| 5 | A | 810 | 0.07 | 1030 | 9.4 | 660 | 2.5 | 60 | 10 |
| 6 | A | 810 | 0.07 | 1030 | 9.4 | 660 | 2.5 | 60 | 100 |
| 7 | A | 810 | 0.07 | 1030 | 9.4 | 660 | 2.5 | 60 | 300 |
| 8 | B | 840 | 0.11 | 920 | 9.2 | 660 | 2.0 | 60 | 10 |
| 9 | B | 840 | 0.11 | 920 | 9.2 | 660 | 2.0 | 60 | 30 |
| 10 | B | 840 | 0.11 | 920 | 9.2 | 660 | 2.0 | 60 | 50 |
| 11 | B | 840 | 0.11 | 920 | 9.2 | 660 | 2.0 | 60 | 100 |
| 12 | B | 840 | 0.11 | 920 | 9.2 | 660 | 2.0 | 60 | 500 |
| 13 | B | 840 | 0.11 | 920 | 9.2 | 660 | 2.0 | 60 | 1000 |
| 14 | B | 840 | 0.11 | 920 | 9.2 | 660 | 2.0 | 60 | 500 |

TABLE 5-continued

| | | | | | | | | | |
|---|---|---|---|---|---|---|---|---|---|
| 15 | B | 840 | 0.11 | 920 | 9.2 | 660 | 2.0 | 60 | 500 |
| 16 | B | 840 | 0.11 | 920 | 9.2 | 660 | 2.0 | 60 | 500 |
| 17 | B | 840 | 0.11 | 920 | 9.2 | 660 | 2.1 | 60 | 1000 |
| 18 | B | 840 | 0.11 | 920 | 9.2 | 660 | 2.1 | 60 | 10 |
| 19 | B | 840 | 0.11 | 920 | 9.2 | 660 | 2.1 | 60 | 1000 |
| 20 | B | 840 | 2.0 | 250 | 9.5 | 650 | 4.5 | 60 | 10 |
| 21 | B | 840 | 2.0 | 250 | 9.5 | 650 | 4.5 | 60 | 500 |
| 22 | B | 880 | 3.1 | 200 | 12 | 720 | 6.1 | 60 | 100 |
| 23 | B | 880 | 3.1 | 200 | 12 | 720 | 6.1 | 60 | 1000 |
| 24 | C | 800 | 0.06 | 920 | 9.4 | 630 | 2.0 | 60 | 10 |
| 25 | C | 800 | 0.06 | 920 | 9.4 | 630 | 2.0 | 60 | 300 |
| 26 | C | 800 | 0.06 | 920 | 9.4 | 630 | 2.0 | 60 | 1000 |
| 27 | C | 850 | 5.2 | 100 | 10.2 | 700 | 5.1 | 60 | 500 |
| 28 | D | 810 | 0.07 | 1130 | 9.8 | 640 | 2.3 | 60 | 300 |
| 29 | D | 810 | 0.07 | 1130 | 9.8 | 640 | 2.3 | 60 | 1000 |
| 30 | D | 810 | 0.07 | 1130 | 9.8 | 640 | 2.3 | 60 | 300 |
| 31 | E | 810 | 0.07 | 1130 | 9.8 | 640 | 2.2 | 60 | 10 |
| 32 | E | 810 | 0.07 | 1130 | 9.8 | 640 | 2.2 | 60 | 1000 |
| 33 | F | 810 | 0.07 | 1130 | 9.8 | 640 | 2.3 | 55 | 10 |
| 34 | F | 810 | 0.07 | 1130 | 9.8 | 640 | 2.3 | 55 | 500 |
| 35 | G | 820 | 0.100 | 800 | 9.20 | 650 | 2.2 | 50 | 10 |
| 36 | G | 820 | 0.100 | 800 | 9.20 | 650 | 2.2 | 50 | 300 |
| 37 | H | 810 | 0.075 | 950 | 10.00 | 650 | 2.1 | 55 | 10 |
| 38 | H | 810 | 0.075 | 950 | 10.00 | 650 | 2.1 | 55 | 500 |
| 39 | I | 820 | 0.09 | 880 | 9.5 | 650 | 2.9 | 55 | 10 |
| 40 | I | 820 | 0.09 | 880 | 9.5 | 650 | 2.9 | 55 | 100 |
| 41 | I | 820 | 0.09 | 880 | 9.5 | 650 | 2.9 | 55 | 10 |
| 42 | I | 820 | 0.09 | 880 | 9.5 | 650 | 2.9 | 55 | 500 |
| 43 | J | 910 | 0.22 | 740 | 10.2 | 680 | 1.7 | 53 | 10 |
| 44 | J | 910 | 0.22 | 740 | 10.2 | 680 | 1.7 | 53 | 100 |
| 45 | K | 910 | 0.21 | 780 | 15 | 650 | 11.4 | 80 | 10 |
| 46 | K | 910 | 0.21 | 780 | 15 | 650 | 11.4 | 80 | 500 |
| 47 | K | 910 | 0.21 | 780 | 15 | 650 | 11.4 | 80 | 500 |

| Steel | | Cold rolling/annealing conditions | | | Properties of cold-rolled steel sheet[3)] | | | | |
|---|---|---|---|---|---|---|---|---|---|
| | | % unrecrystallized | Annealing | | | | | | |
| sheet No. | Steel type | ferrite at $Ae_1 + 10°$ C. | Temp. (° C.) | Time (sec) | YS (MPa) | TS (MPa) | El (%) | $d_m$ | Category |
| 1 | A | 23 | 750 | 60 | 422 | 659 | 27.0 | 3.2 | Comparative |
| 2 | A | 87 | 750 | 60 | 524 | 697 | 23.4 | 2.0 | Inventive |
| 3 | A | 97 | 750 | 60 | 506 | 703 | 22.3 | 1.7 | Inventive |
| 4 | A | 97 | 720 | 60 | 416 | 710 | 21.6 | 1.6 | Inventive |
| 5 | A | 8 | 850 | 60 | 430 | 610 | 27.4 | 3.5 | Comparative |
| 6 | A | 87 | 850 | 60 | 454 | 607 | 23.0 | 3.3 | Comparative |
| 7 | A | 97 | 850 | 60 | 474 | 626 | 21.6 | 3.6 | Comparative |
| 8 | B | 8 | 750 | 60 | 428 | 487 | 32.8 | 3.7 | Comparative |
| 9 | B | 19 | 750 | 60 | 454 | 497 | 32.2 | 3.6 | Comparative |
| 10 | B | 46 | 750 | 60 | 460 | 502 | 30.7 | 3.1 | Inventive |
| 11 | B | 72 | 750 | 60 | 466 | 499 | 29.6 | 2.7 | Inventive |
| 12 | B | 96 | 750 | 60 | 482 | 516 | 28.1 | 2.4 | Inventive |
| 13 | B | 97 | 750 | 60 | 496 | 528 | 28.3 | 2.3 | Inventive |
| 14 | B | 96 | 750 | 15* | 530 | 553 | 22.3 | 1.8 | Comparative |
| 15 | B | 96 | 750 | 200 | 475 | 508 | 29.3 | 2.5 | Inventive |
| 16 | B | 96 | 750 | 300 | 468 | 505 | 29.8 | 2.6 | Inventive |
| 17 | B | — | 650 | 60 | 426 | 462 | 30.0 | 4.1 | Comparative |
| 18 | B | 8 | 850 | 60 | 404 | 482 | 31.5 | 4.7 | Comparative |
| 19 | B | 97 | 850 | 60 | 389 | 481 | 31.5 | 4.5 | Comparative |
| 20 | B | 12 | 750 | 60 | 429 | 490 | 32.7 | 5.2 | Comparative |
| 21 | B | 97 | 750 | 60 | 435 | 491 | 30.0 | 4.5 | Comparative |
| 22 | B | 81 | 750 | 60 | 418 | 471 | 30.2 | 4.9 | Comparative |
| 23 | B | 96 | 750 | 60 | 409 | 468 | 35.0 | 4.8 | Comparative |
| 24 | C | 21 | 800 | 60 | 534 | 619 | 25.9 | 3.8 | Comparative |
| 25 | C | 92 | 800 | 60 | 563 | 681 | 21.4 | 1.8 | Inventive |
| 26 | C | 98 | 800 | 60 | 571 | 692 | 21.1 | 1.7 | Inventive |
| 27 | C | 87 | 800 | 60 | 473 | 611 | 25.9 | 3.9 | Comparative |
| 28 | D | 84 | 750 | 60 | 511 | 552 | 26.5 | 2.6 | Inventive |
| 29 | D | 95 | 750 | 60 | 527 | 565 | 26.1 | 2.3 | Inventive |
| 30 | D | 78 | 850 | 60 | 434 | 539 | 26.4 | 5.2 | Comparative |
| 31 | E | 18 | 750 | 60 | 542 | 628 | 21.5 | 3.7 | Comparative |
| 32 | E | 96 | 750 | 60 | 602 | 657 | 20.9 | 1.9 | Inventive |
| 33 | F | 16 | 750 | 60 | 574 | 899 | 19.9 | 2.5 | Comparative |
| 34 | F | 97 | 800 | 60 | 503 | 732 | 23.8 | 1.7 | Inventive |
| 35 | G | 24 | 800 | 60 | 511 | 921 | 21.5 | 3.3 | Comparative |
| 36 | G | 87 | 800 | 60 | 532 | 955 | 21.2 | 1.8 | Inventive |
| 37 | H | 23 | 800 | 60 | 582 | 866 | 22.1 | 3.4 | Comparative |
| 38 | H | 97 | 800 | 60 | 641 | 896 | 20.8 | 1.7 | Inventive |
| 39 | I | 22 | 750 | 60 | 332 | 617 | 24.4 | 3.5 | Comparative |

TABLE 5-continued

| | | | | | | | | | |
|---|---|---|---|---|---|---|---|---|---|
| 40 | I | 68 | 750 | 60 | 360 | 636 | 25.8 | 2.6 | Inventive |
| 41 | I | 22 | 840 | 60 | 421 | 593 | 31.6 | 3.6 | Comparative |
| 42 | I | 97 | 840 | 60 | 470 | 605 | 29.4 | 3.5 | Comparative |
| 43 | J | 43 | 800 | 60 | 624 | 848 | 28.8 | 3.2 | Comparative |
| 44 | J | 89 | 800 | 60 | 582 | 876 | 26.8 | 1.6 | Inventive |
| 45 | K | 0 | 750 | 30 | 149 | 333 | 45.6 | 10.6 | Comparative |
| 46 | K | 0 | 750 | 30 | 152 | 334.5 | 44.6 | 8.9 | Comparative |
| 47 | K | 0 | 940 | 30 | 163 | 282 | 48.0 | 49.7 | Comparative |

Underlining indicates values ouside the range of the present invention;
*indicates that the holding time for annealing was too short and manufacture was unstable.
1)Cooling time from completion of rolling to 750° C.;
2)Holding time in the range of 720° C. to 500° C.;
3)YS = yield strength, TS = tensile strength, El = total elongation.

Of cold-rolled steel sheets Nos. 1-7 which were manufactured using steel type A, the tensile strength had a high value of 697-710 MPa for Nos. 2-4 which were manufactured in accordance with the present invention. In addition, the total elongation exceeded 20% for each steel sheet. On the other hand, for the steel of steel sheet No. 1, the cooling rate at the time of annealing after cold rolling was slow, and the percentage of unrecrystallized ferrite was less than 30%. For this reason, the grain diameter of ferrite was large, and the tensile strength decreased. For steel sheets Nos. 5-7, due to the annealing temperature which was too high, the grain diameter of ferrite did not fall into the range defined by the present invention, and the tensile strength was around 100 MPa lower than for steel sheets 2-4.

The same tendency was observed with cold-rolled steel sheets manufactured using steel type B. In addition, for steel sheet No. 14 of steel type B, because of the annealing time which was too short, the total elongation was lower than for other cold-rolled steel sheets using the same steel type B, and even when steel sheets were manufactured a plurality of times under the same conditions as for No. 14, stable manufacture was not possible with properties varying from one location to another within the same steel sheet. For steel sheet No. 17 of steel type B, due to the annealing temperature after cold rolling which was a low value of 650° C., a sufficient amount of austenite was not formed, the grain diameter of ferrite became large, and tensile strength decreased. For steel sheets Nos. 20-23 of steel type B, since the rapid cooling after hot rolling was insufficient, the hot-rolled steel sheet which was subjected to cold rolling had a large grain diameter of ferrite. As a result, the grain diameter of ferrite after cold rolling became large, and tensile strength decreased.

The above-described tendency which was observed with cold-rolled steel sheets of steel types A and B was similarly observed for cold-rolled steel sheets which were manufactured using the remaining steel types C-J having a chemical composition in the range of the present invention.

For steel sheets Nos. 45-47 which were manufactured using steel type K, since they did not have a chemical composition defined by the present invention, even if hot rolling was carried out by immediate rapid cooling, the grain diameter of ferrite in the hot-rolled steel sheets became large. As a result, the grain diameter of ferrite in the cold-rolled steel sheet could not be refined by varying the annealing temperature, and the tensile strength became extremely low.

The invention claimed is:

1. A cold-rolled steel sheet characterized by having:

a chemical composition comprising, in mass %, C: 0.01-0.3, Si: 0.01-2.0, Mn: 0.5-3.5, P: at most 0.1, S: at most 0.05, Nb: 0-0.03, Ti: 0-0.06, V: 0-0.3, sol. Al: 0-2.0, Cr: 0-1.0, Mo: 0-0.3, B: 0-0.003, Ca: 0-0.003, REM: 0-0.003, and a remainder of Fe and impurities;

a microstructure having a main phase of ferrite which comprises at least 50% by area and a second phase containing a total of at least 10% by area of a low temperature transformation phase including one or more of martensite, bainite, pearlite, and cementite and 0-3% by area of retained austenite, and satisfying Equations (1), (2) and (3) below; and a texture in which the average X-ray intensity for the [111]<145>, [111]<123>, and [554]<225> orientations at a depth of ½ of a sheet thickness is at least 4.0 times an average X-ray intensity of a random structure which does not have a texture;

$$d_m < E_1; \quad \text{Equation (1):}$$

$$d_m < 4.0; \quad \text{Equation (2):}$$

$$d_s \leq 1.5; \quad \text{Equation (3):}$$

wherein $E_1$ in Equation (1) represents a calculated value for the cold rolled sheet and calculated by $E_1=2.7+10000/(5+300\times C+50\times Mn+4000\times Nb+2000\times Ti+400\times V)^2$, wherein C, Mn, Nb, Ti, and V indicate the contents in mass % of the respective elements;

in Equations (1) and (2), $d_m$, is a physical value of the cold rolled sheet characterized by an average grain diameter in μm of ferrite defined by a high angle grain boundary having a tilt angle of at least 15 degrees; and in Equation (3), $d_s$, is a physical value of the cold rolled sheet characterized by an average grain diameter in μm of the second phase.

2. A cold-rolled steel sheet as set forth in claim 1 wherein the chemical composition contains, in mass percent, one or more elements selected from the group consisting of Nb: 0.003-0.03, Ti: 0.005-0.06, and V: 0.01-0.3; and the microstructure satisfies Equation (4) wherein $$d_m < 3.5. \quad \text{Equation (4):}$$

3. A cold-rolled steel sheet as set forth in claim 1 wherein the chemical composition contains, in mass percent, sol. Al: 0.1-2.0.

4. A cold-rolled steel sheet as set forth in claim 1 wherein the chemical composition contains, in mass percent, one or more elements selected from the group consisting of Cr: 0.03-1.0, Mo: 0.01-0.3 and B: 0.0005-0.003.

5. A cold-rolled steel sheet as set forth in claim 1 wherein the chemical composition contains, in mass percent, one or more elements selected from the group consisting of Ca: 0.0005-0.003 and REM: 0.0005-0.003.

6. A cold-rolled steel sheet as set forth in claim 1 which has a plating layer on the surface of the steel sheet.

7. A process for manufacturing a cold-rolled steel sheet characterized by comprising the following steps (A) and (B):

step (A) a cold rolling step in which a hot-rolled steel sheet having a chemical composition as set forth in any of claims 1 to 5 and having a microstructure which satisfies Equations (5) and (6) below is subjected to cold rolling to obtain a cold-rolled steel sheet; and step (B) an annealing step in which the cold-rolled steel sheet obtained in step (A) is subjected to annealing by increasing the temperature of the steel sheet to a temperature range of at least ($Ae_1$ point+10° C.) to at most ($0.95\times Ae_3$ point+$0.05\times Ae_1$ point) under conditions such that the proportion of unrecrystallized ferrite is at least 30% by area when the temperature ($Ae_1$ point+10° C.) is reached and then holding the steel sheet in this temperature range for at least 30 seconds, wherein a rate of temperature increase at the time of annealing is at least 50° C. per second;

Equation (5): $d_n<E_5$;

Equation (6): $d_n<3.5$;

wherein $E_5$ in Equation (5) represents a calculated value for the hot rolled sheet and calculated by $E_5=2.5+60001(5+300\times C+40\times Mn)^2$, wherein C and Mn indicate the contents in mass % of the respective elements;

in Equations (5) and (6), $d_n$, is a physical value of the hot rolled sheet characterized by an average grain diameter of ferrite in μm defined by a high angle grain boundary having a tilt angle of at least 15 degrees;

wherein the hot-rolled steel sheet is obtained by a hot rolling step comprising performing hot rolling with a temperature at completion of rolling of at least the $Ar_3$ point on a slab having the above-described chemical composition and then performing cooling to a temperature range of 750° C. or below at an average cooling rate of at least 400° C. per second within 0.4 seconds after completion of rolling.

8. A process for manufacturing a cold-rolled steel sheet as set forth in claim 7 further having a step of carrying out plating on the cold-rolled steel sheet after step (B).

* * * * *